US006401949B1

(12) United States Patent
Lyle et al.

(10) Patent No.: US 6,401,949 B1
(45) Date of Patent: Jun. 11, 2002

(54) SEALING MEMBRANE FOR BABY BOTTLE OR OTHER FLUID CONTAINER

(75) Inventors: Michael A. Lyle, Gainesville; Leslie Jones Talbott; Timothy Talbott, both of Alpharetta; William R. Greene, Mt. Airy, all of GA (US)

(73) Assignee: Babeetender, Inc., Atlanta, GA (US)

( * ) Notice: Subject to any disclaimer, the term of this patent is extended or adjusted under 35 U.S.C. 154(b) by 0 days.

(21) Appl. No.: 09/656,501

(22) Filed: Sep. 7, 2000

(51) Int. Cl.[7] ..... A61J 9/00
(52) U.S. Cl. ..... 215/11.4; 215/11.1
(58) Field of Search ..... 215/11.1, 11.4, 215/11.5

(56) References Cited

U.S. PATENT DOCUMENTS

| | | | | | |
|---|---|---|---|---|---|
| 2,745,568 | A | * | 5/1956 | Newton | 215/11.1 X |
| 2,747,573 | A | | 5/1956 | Schaich | 128/252 |
| 2,917,048 | A | * | 12/1959 | Soto | 215/11.1 X |
| 3,146,904 | A | * | 9/1964 | Hansen et al. | 215/11.1 X |
| 3,211,315 | A | * | 10/1965 | Griesinger | 215/11.1 X |
| 3,335,890 | A | * | 8/1967 | Grundmann | 215/11.1 X |
| 3,385,297 | A | | 5/1968 | Yazaki | 128/252 |
| 3,393,817 | A | * | 7/1968 | Meierhoefer | 215/11.4 |
| 3,516,564 | A | * | 6/1970 | Pohlenz | 215/11.1 X |
| 3,655,083 | A | * | 4/1972 | Eberhardt et al. | 215/11.4 X |
| 3,677,429 | A | * | 7/1972 | La Barge | 215/11.1 X |
| 3,760,967 | A | * | 9/1973 | Welch et al. | 215/11.1 X |
| 3,946,888 | A | * | 3/1976 | Tonkin | 215/11.4 X |
| 5,150,800 | A | * | 9/1992 | Sarter et a. | 215/11.1 X |
| 5,211,300 | A | | 5/1993 | Hsing et al. | 215/11.4 |
| 5,295,597 | A | | 3/1994 | Green | 215/11.4 |
| 5,354,274 | A | * | 10/1994 | Demeter et al. | 215/11.1 X |
| 5,535,899 | A | * | 7/1996 | Carlson | 215/11.1 |
| 5,667,084 | A | | 9/1997 | Duggal et al. | 215/11.4 |
| 5,747,083 | A | | 5/1998 | Raymond et al. | 426/117 |
| 5,791,503 | A | | 8/1998 | Lyons | 215/11.5 |
| 5,893,472 | A | | 4/1999 | Forrer | 215/11.4 |

* cited by examiner

*Primary Examiner*—Stephen P. Garbe
*Assistant Examiner*—Tri M. Mai
(74) *Attorney, Agent, or Firm*—Baker, Donelson, Bearman & Caldwell

(57) ABSTRACT

A baby bottle (10) having a dispensing member (20) and a sealing membrane (14) disposed between the dispensing member (20) and an open end (15) of the container (10). A threaded collar (26) engages the open end and a shoulder (34) extends laterally adjacent an extent of the thread. The sealing membrane (14) includes ports (42) for communicating fluid therethrough. The sealing membrane (14) moves from a sealing position with a sealing surface (24) in bearing contact with the open end (15) and a dispensing position with the sealing surface (24) spaced apart from the open end for fluid flow through the ports (42). The sealing membrane moves in response to the shoulder (34) moving as the collar (26) is rotated and moved longitudinally outwardly relative to the end (15) by the camming action of the thread on the bottle (10).

17 Claims, 2 Drawing Sheets

SEALING MEMBRANE FOR BABY BOTTLE OR OTHER FLUID CONTAINER

TECHNICAL FIELD

The present invention relates to containers. More particularly, the present invention relates to containers for fluids having seals for closing the container to the flow of fluids from the containers.

BACKGROUND OF THE INVENTION

Containers are well-known bodies adapted for holding fluids. Typically, fluid-holding containers are open-ended bodies, and may be closable or not. For example, glassware commonly comprises a tubular body with a bottom and defining side walls and an open end for the fluid to pass into and out of the body. Other containers for fluids are closable. Often these containers define a thread on an exterior surface near the open end. A closure device, such as a cap or top, includes a mating thread on an interior face. The cap threads onto the open end to close the container. The cap typically is selectively removed to provide access to the container, and replaced to reclose the container.

Some containers hold products that must be sealed from the atmosphere until use. Often these containers have inner membranes applied across the open end to seal the contents. The inner membrane is unsealed after removing the cap to provide access to the contents.

Bottles holding drinking fluids, such as soft drinks, water, and milk for babies, are often re-sealed for subsequent use of the contents. Baby bottles typically are elongate tubes with a threaded open end and graduations marked on the side wall of the bottle. A resilient nipple having exit holes in a distal end is received on the open end. An annular cap with a threaded skirt couples the nipple to the bottle. Other containers suited for drinking materials include a ported spout that selectively opens. One such spout is pulled to move the spout relative to a longitudinal axis of the bottle and thereby open and close the bottle.

Babies may not completely drink the contents of the bottle, and parents often want to re-close the bottle to save the contents for a subsequent feeding. Some baby bottles include a disk-shaped lid that closes the annular opening in the cap and seals the open end of the nipple, which is typically inverted and disposed inwardly of the bottle. However, this necessitates handling of the nipple and opening the bottle to atmosphere. Similarly, containers for sports and other types of beverages are often partially consumed, with the remaining contents retained for subsequent drinking.

Accordingly, there is a need in the art for and improved container for fluids which is unsealed for use and readily resealed for subsequent use of the remaining contents. It is to such that the present invention is directed.

SUMMARY OF THE PRESENT INVENTION

The present invention meets the need in the art by providing containers for fluids with a selectively actuated seal for closing the flow of fluids from the containers. The container comprises a receiving body for holding a fluid and having an open end. A collar that engages the open end of the receiving body includes a dispensing member attached to the collar for communicating fluids from the receiving body. A sealing membrane disposed between the collar and the open end of the receiving body selectively seals fluid flow from the receiving body. The sealing membrane moves selectively more than once from a sealing position with a sealing surface of the sealing membrane in bearing contact with an edge surface of the open end to a dispensing position with the sealing surface spaced apart from the open end for fluid flow, in response to movement of an actuator.

In another aspect, the container comprises a receiving body for holding a fluid and having an open end with an external thread. A rotatable collar having an internal thread engages the thread on the open end of the receiving body. The interior of the collar defines a shoulder adjacent an extent of the thread. A dispensing member attaches to the collar for communicating fluids from the receiving body. A sealing membrane is disposed between the dispensing member and the open end, with at least one port in a perimeter portion for communicating fluid therethrough. The sealing membrane moves from a sealing position with a sealing surface of the membrane in bearing contact with an edge surface of the open end and a dispensing position with the sealing surface spaced apart from the open end for fluid flow. The sealing membrane moves in response to rotating the collar to move the collar longitudinally outwardly relative to the end by the camming action of the thread on the container. The shoulder breaks the seal between the sealing membrane and the edge of the container.

Further objects, features, and advantages of the present invention will become apparent from a reading of the following specification, in conjunction with the drawings and the appended claims.

DETAILED DESCRIPTION OF THE PREFERRED EMBODIMENTS

Figure 1:
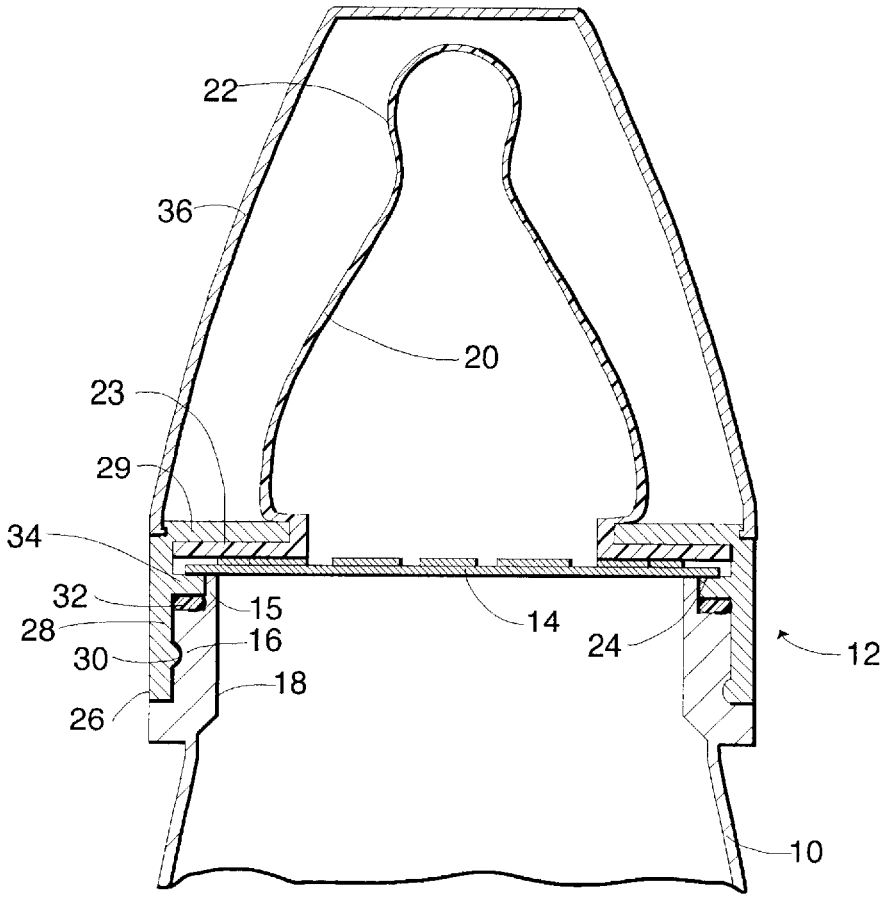
FIG. 1 is cut-away sectional view of a baby bottle having a sealing apparatus according to the present invention.

Referring now in more detail to the drawings, in which like numerals indicate like parts throughout the several views, FIG. 1 illustrates in cut-away sectional view a baby bottle 10 having a sealing apparatus generally 12 according to the present invention. The sealing apparatus 12 includes a sealing membrane 14 received on an open end 15 of the bottle 10. The bottle 10 includes a side wall 18 with an exterior thread 16 in a portion near the open end. The side wall 18 extends to a closed end (not illustrated) for holding a fluid within the bottle 10.

The open end 15 receives the sealing membrane 14 and a nipple 20. The nipple 20 is conventional with a protruding extension 22 and laterally extending flange 23. A distal end of the extension 22 defines an aperture for communicating fluids. A sealing surface 24 of the sealing membrane 14 is disposed for contacting an edge of the side wall 18 defining the open end 15. An annular clamp ring 26 defines an opening through which the nipple 20 extends. The clamp ring 26 includes a depending skirt 28 and a radially inwardly extending flange 29. The skirt 28 defines on an inner surface a thread 30 that matingly engages the thread 16 at the open end.

The illustrated embodiment of the baby bottle 10 includes a secondary seal 32 disposed longitudinally inwardly of the open end 15 for sealing between the skirt 28 and the bottle 10, as discussed below. The skirt 25 defines a shoulder 34 near a distal extent of the thread 30. The shoulder 34 extends radially inwardly from the skirt 28. The shoulder 34 contacts the sealing surface 24 of the sealing membrane 14. As discussed below, movement of the shoulder 34 actuates the release of the seal of the sealing membrane 14 from the open end 15 of the bottle 10. A removable nipple guard 36 covers the nipple 20 and is readily re-installed by slipping the guard over the nipple following use of the bottle 10.

Figure 2:
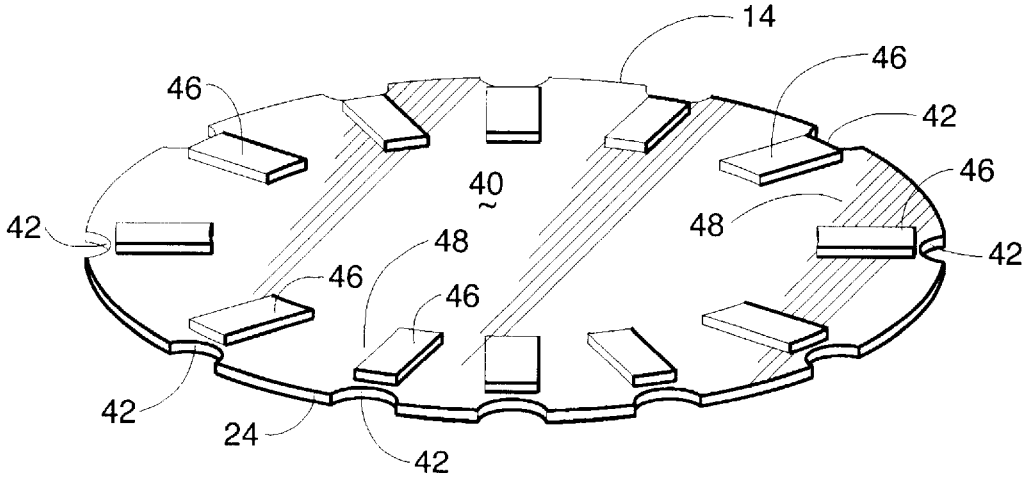
FIG. 2 is an upper perspective view of a sealing membrane in accordance with the present invention used in the baby bottle illustrated in FIG. 1.

FIG. 2 illustrates an upper perspective view of the sealing membrane 14 in accordance with the present invention. The sealing membrane 14 in the illustrated embodiment is an annular, substantially flat resilient disc with the sealing surface 24 and an opposing anterior flow surface 40. A plurality of ports 42 are defined in spaced-apart relation in perimeter portions of the sealing membrane 14. The ports 42 in the illustrated embodiment define semi-circular slots at the perimeter edge of the sealing membrane 14. Other geometric shapes for the ports 42 may be gainfully used to facilitate the flow from the bottle 10 across the perimeter edge of the sealing membrane 14 when the seal is released, as discussed below. The anterior surface 40 of the sealing membrane 14 in the illustrated embodiment further defines a plurality of anterior bosses 46 that extend from the flow surface. The bosses 46 are spaced-apart and extend radially on the flow surface 40. The bosses 46 define fluid flow pathways 48 between adjacent bosses. While the ports 42 and the bosses 46 facilitate the flow of the fluids, these features are not necessary to effect and to release the seal in the valving structure of the present invention.

With reference to FIG. 1, the sealing membrane 14 cooperates with the clamp ring 26 to seal the contents of the baby bottle 10. The nipple 20 is received into the clamp ring 26 with the flange 23 bearing against the flange 29. The sealing membrane 14 is positioned within the clamp ring 26 with the perimeter edge of the sealing membrane received between the flange 23 of the nipple 20 and the shoulder 34 of the clamp ring. The protruding extension 22 of the nipple 20 extends through the opening defined by the flange 29 of the clamp ring 26.

The baby bottle 10 is initially filled with a fluid, such as a milk product for a baby. The sealing membrane 14 is placed on the edge 25 of the open end 15. The clamp ring 26 with the nipple 20 is placed on the baby bottle 10. The thread 30 engages the thread 16 of the bottle 10 at the open end 15. The flange 29 of the clamp ring 26 bears against the flange 23 of the nipple 20 and thus against the perimeter portion of the sealing membrane 20. Tightening the clamp ring 26 by rotating the ring relative to the bottle 10 forces the perimeter portion firmly against the edge of the open end 15. This seals the bottle 10 to fluid flow from the open end 15. The nipple guard 36 detachably covers the nipple 20.

Figure 3:
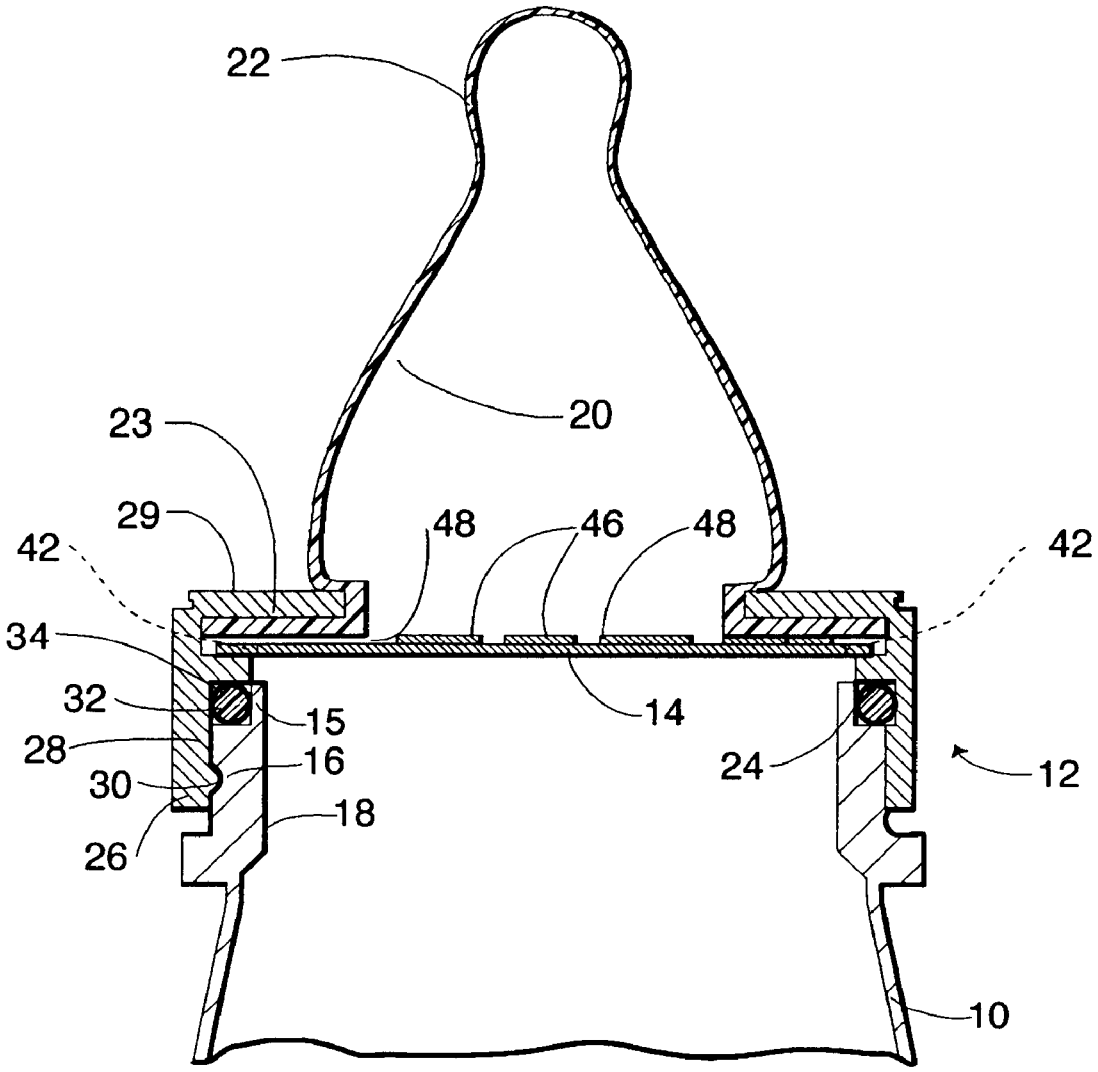
FIG. 3 is a cut-away sectional view of the baby bottle illustrated in FIG. 1 showing the sealing membrane in the dispensing position.

For use, the baby bottle 10 is unsealed. This allows the milk to flow from the bottle 10 past the sealing membrane 14 and through the aperture in the nipple 20. With reference to FIG. 3, this is accomplished by rotating the clamp ring 26 in a reverse direction. The thread 16 functions as a cam to move the clamp ring 26 longitudinally outwardly relative to the end 15. The shoulder 34 engages the radially distal edge portion of the sealing membrane 14. As the clamp ring 26 moves longitudinally, the shoulder 34 induces a release of the sealing engagement of the perimeter portion of the sealing membrane 14 against the end 15. The shoulder 34 thereby defines an actuator for releasing the sealing engagement of the sealing membrane 14 and the bottle 10. In the illustrated embodiment, the ports 42 are opened to fluid flow as the portion of the sealing membrane 14 about these ports are likewise released from sealing engagement.

With the bottle 10 then inverted, milk begins to flow through the ports 42 and across the flow surface 40. The fluid flows along the fluid pathways 48 to the nipple 20 for communicating through the aperture outwardly of the bottle 10. The bosses 46 bear against a bottom surface of the flange 23 of the nipple 20 to maintain the flow pathways 48 over the flow surface 40 of the sealing membrane 14. The bosses 46 in an alternate embodiment (not illustrated) are molded integral with the nipple 20 and extend from the flange 23 towards the sealing membrane 14. The secondary seal 32 seals between the skirt 28 and the bottle 10 to prevent fluid from leaking past the skirt 25. The clamp ring 26 bears against a perimeter edge of the flange 23 of the nipple 20 to form another secondary seal to prevent fluid flow between these members.

A remaining portion of the contents of the baby bottle 10 are readily resealed therein for subsequent use. The resealing is accomplished by rotating the clamp ring 26 relative to the threaded open end 15 to tighten the clamp ring to the bottle 10. The flange 29 of the clamp ring 26 again bears against the flange 23 of the nipple 20 and thus against the perimeter portion 44 of the sealing membrane 14. This forces the perimeter portion firmly against the open end 15. The bottle 10 is thereby resealed to fluid flow from the open end 15.

It is to be appreciated with respect to the present invention that the thread provides a satisfactory cam for guiding the longitudinal travel of the clamp ring 26 for unsealing and sealing the sealing membrane 14. For example, a course thread may provide a 1/16 inch longitudinal movement with less than a 120 degree rotation or twist of the clamp ring 26. Such slight rotational movement is sufficient for the shoulder 34 to induce release of the sealed ports 42 without undue release of the clamping action holding the sealing membrane 14 and the nipple 20 to the open end of the bottle.

The secondary seal 32 that seals inwardly of the edge 25 between the skirt 28 and the bottle 10 in one embodiment is a molded feature of the bottle 10. In another embodiment, the secondary seal 32 is a resilient ring added to the assembly of the bottle 10.

The sealing assembly 12 with the sealing membrane 14 and the clamp ring 26 cooperatively provide a novel sealing mechanism that allows a person using the bottle 10 to break and open the seal of the contents by rotatably twisting the clamp ring 26 relative to the bottle 10 and readily reseal the bottle by reverse rotation of the clamp ring. The shoulder 34 moves the sealing membrane 14 to the dispensing position, while the flange 29 moves the sealing membrane to the sealing position. This provides in one aspect a push-pull valving action on the sealing membrane 14 and the end of the bottle 10 for affecting and releasing the seal of the sealing membrane.

It is to be appreciated that a break-away tamper ring (not illustrated) may be detachably engaged to the clamp ring 26. The clamp ring 26 is not rotatable until the break-away tamper ring is detached. Further, the bottle with the nipple guard 36 may be enclosed with a shrink-wrap type security covering (not illustrated) to provide an additional tamper indicator for retail sale of bottles with sealing membranes in accordance with the present invention. It is to be appreciated that while the specification describes the present invention with respect to a baby bottle, the sealing apparatus is readily usable with a sports drink bottle or the like, in which a dispensing spout with a radially extending flange is received within the clamp ring 26, for unsealing and sealing the container for subsequent use of the remainder fluids.

The specification has thus described in various embodiments the sealing membrane of the present invention including the manufacture and use thereof. It is to be understood, however, that numerous changes and variations may be made in the construction of the present invention. It should therefore be understood that modifications to the present invention may be made without departing from the scope thereof as set forth in the appended claims.

What is claimed is:

1. A container for fluids with a selectively actuated seal for closing the flow of fluids from the container, comprising:

a receiving body for holding a fluid and having an open end;

a collar that engages the open end of the receiving body;

a dispensing member attached to the collar for communicating fluids from the receiving body;

a sealing membrane disposed between the collar and the open end of the receiving body for sealing fluid flow; and an actuator for moving the sealing membrane selectively more than once from a sealing position with a sealing surface of the sealing membrane in bearing contact with an edge surface of the open end and a dispensing position with the sealing surface spaced apart from the open end for fluid flow.

2. The container as recited in claim 1, wherein the actuator comprises a shoulder on the collar that moves the sealing membrane between the sealing position and the dispensing position.

3. The container as recited in claim 1, wherein the collar includes a radially inward portion for selectively moving more than once the sealing membrane from a dispensing position with the sealing surface spaced apart from the open end for fluid flow and a sealing position with the sealing surface of the sealing membrane in bearing contact with the edge surface of the open end.

4. The container for fluids as recited in claim 1, wherein the sealing membrane defines at least one port in a perimeter portion for communicating fluid therethrough.

5. The container as recited in claim 1, further comprising a plurality of anterior bosses disposed between the sealing membrane and the dispensing member.

6. The container as recited in claim 1, wherein the sealing membrane defines a plurality of anterior bosses extending from a surface opposing the sealing surface, for engaging contact with the dispensing member, whereby the bosses define fluid pathways between the sealing membrane and the dispensing member for communication of the fluid.

7. The container as recited in claim 1, further comprising a sealing ring received in the rotatable collar at a distal edge portion for sealing the collar to the open end portion of the receiving body.

8. The container as recited in claim 1, wherein the receiving body is a baby bottle and the dispensing member comprises a nipple therefor.

9. The container for fluids as recited in claim 1, wherein the receiving body defines a threaded open end;

wherein the collar is threaded for engaging the threaded open end of the receiving body; and wherein the actuator extends from the collar adjacent an extent of the thread in the collar, whereby rotating the collar causes the actuator to move against a perimeter portion of the sealing membrane and release the seal thereof with the receiving body.

10. The container as recited in claim 9, wherein the actuator comprises a shoulder projecting laterally inwardly from an inner surface of the collar.

11. A method of selectively sealing and opening a container for fluids to the flow of fluids from the container, comprising the steps of:

(a) attaching an annular collar to engage open end of a fluid container, with a dispensing member extending therefrom for communicating fluids from the fluid container;

(b) moving the collar relative to the fluid container to bear a sealing membrane against the end of the fluid container to seal the fluid container from communication of fluid therefrom; and (c) selectively moving a shoulder of the collar against a perimeter portion of the sealing member to release the seal with the fluid container, whereby fluid communicates around the sealing member and through the dispensing member from the fluid container.

12. The method as recited in claim 11, whereby the shoulder moves in steps (b) and (c) in response to rotating the collar in a first direction and a second opposite direction to displace the collar longitudinally relative to the fluid container.

13. The method as recited in claim 11, further comprising the step of repeating step (b) to selectively reseal the fluid container to the flow of fluid.

14. A baby bottle for fluids with a selectively actuated seal for closing the flow of fluids from the baby bottle, comprising:

a body for holding a fluid and having a threaded open end;

a threaded collar for engaging the thread on the open end of the body;

a shoulder defined on the interior of the collar;

a nipple attached to the collar for communicating fluids from the receiving body; and a sealing membrane having at least one port in a perimeter portion for communicating fluid therethrough, the sealing membrane defining a plurality of anterior bosses extending from a surface opposing a sealing surface, for engaging contact with the nipple, whereby the bosses define fluid pathways between the sealing membrane and the nipple, the sealing membrane movable from a sealing position and a dispensing position responsive to rotational movement of the collar which causes the shoulder to release the seal between the sealing membrane and the end of the bottle.

15. The baby bottle as recited in claim 14, wherein the collar includes a radially inward portion for selectively moving more than once the sealing membrane from a dispensing position with the sealing surface spaced apart from the open end for fluid flow and a sealing position with the sealing surface of the sealing membrane in bearing contact with the edge surface of the open end.

16. A bottle for fluids with a selectively actuated seal for closing the flow of fluids from the bottle, comprising:

a body for holding a fluid and having a threaded open end;

a threaded collar for engaging the thread on the open end of the body;

a shoulder defined on the interior of the collar;

a dispensing member secured to the open end of the body by the collar for communicating fluids from the body; and a sealing membrane having at least one port in a perimeter portion for communicating fluid therethrough, the sealing membrane defining a plurality of anterior bosses extending from a surface opposing a sealing surface, for engaging contact with the dispensing member, whereby the bosses define fluid pathways between the sealing membrane and the dispensing member, the sealing membrane movable from a sealing position and a dispensing position responsive to rotational movement of the collar which causes the shoulder to release the seal between the sealing membrane and the end of the bottle.

17. The bottle as recited in claim 16, wherein the collar includes a radially inward portion for selectively moving more than once the sealing membrane from a dispensing position with the sealing surface spaced apart from the open end for fluid flow and a sealing position with the sealing surface of the sealing membrane in bearing contact with the edge surface of the open end.

* * * * *